US005148552A

United States Patent [19]

Kress et al.

[11] Patent Number: 5,148,552

[45] Date of Patent: Sep. 22, 1992

[54] ASSEMBLY SPACE COVER FOR AN INSTALLATION MODULE

[75] Inventors: Jürgen Kress, Huglfing; Konrad Breitenberger, Weilheim, both of Fed. Rep. of Germany

[73] Assignee: Gerberit AG, Rapperswil, Switzerland

[21] Appl. No.: 598,208

[22] Filed: Oct. 16, 1990

[30] Foreign Application Priority Data

Oct. 24, 1989 [EP] European Pat. Off. ..... 89 119 777.4

[51] Int. Cl.[5] ..... A47J 47/20; E03D 11/14

[52] U.S. Cl. ..... 4/252.2; 52/37; 285/56; 4/620; 4/643

[58] Field of Search ..... 4/252 R, DIG. 15; 52/35, 307.7; 285/56

[56] References Cited

U.S. PATENT DOCUMENTS 3,470,598 10/1969 Berthelsen ..... 52/309.16
3,765,139 10/1973 Litvin et al. ..... 52/309.7 X
3,924,279 12/1975 Morris et al. ..... 4/252 R
3,942,201 3/1976 Morris et al. ..... 4/252 R
4,434,516 3/1984 Morris et al. ..... 4/252 R
4,903,446 2/1990 Richards et al. ..... 52/309.7 X
4,979,239 12/1990 Klein et al. ..... 4/252 R

FOREIGN PATENT DOCUMENTS 3033291 3/1982 Fed. Rep. of Germany ..... 4/252 R
8800349 1/1988 Fed. Rep. of Germany ... 4/252 R X

*Primary Examiner*—Daniel M. Yasich
*Attorney, Agent, or Firm*—Dellett, Smith-Hill and Bedell

[57] ABSTRACT

As assembly space cover for installation modules, especially foamed ones, in the sanitary field, in the form of a molded apron (5) to be joined to the bottom side of an installation module (1) with its outside surface substantially flush with the front surface of the installation module. A metal reinforcement (7) substantially resistant to bending and embedded in the foam of the apron (5) imparts strength and dimensional stability to the apron.

19 Claims, 2 Drawing Sheets

ASSEMBLY SPACE COVER FOR AN INSTALLATION MODULE

FIELD OF THE INVENTION

The invention relates to an assembly space cover for installation modules, especially foamed ones, in the sanitary field, in the form of a foamed apron to be joined to the bottom side of an installation module with its outside surface substantially flush with the surface of the installation module.

BACKGROUND OF THE INVENTION

In the context of an installation module consisting of a metallic support structure, German utility model 88 00 349, for example, discloses that the assembly space, rather than being filled with masonry, be covered by an apron in the form an apertured steel plate positioned substantially flush with the front wall of the module. This apron is formed with a recess for passage of a drain pipe of the installation module and is adapted to be fixed, on the one hand, to the bottom side of the installation module and, on the other hand, to the bare floor by way of supports which are adjustable in height.

With foamed installation modules it was attempted to obtain a uniform surface for plastering or tiling also by using a foamed apron to cover the assembly space, conveniently made of the same foam compound as the installation module. Yet that caused problems regarding strength and dimensional stability. In a water closet installation module the apron must withstand the standard load (approximately 400 kg) of the water closet suspended from the wall. Sufficient strength has hitherto been obtainable only by use of an apron that is correspondingly thick. However, the space available between the front face of the module and the waste water draining pipe elbow is limited. In spite of greater thickness of the apron, the risk remains that parts will break out, especially so in the area of the fastening connections and at the edges. What has remained unsolved so far is that foamed aprons tend to distort easily.

SUMMARY OF THE INVENTION

It is the object of the invention to provide an assembly space cover in the form of a foamed apron which is characterized by great strength and dimensional stability, while having little thickness.

The apron according to the invention is characterized by the fact that a metal reinforcement substantially resistant to bending is embedded in the foam. This metal reinforcement may be present in the form of welded or plugged structure composed, for example, of sectional beams. The term "plugged" as applied to sectional beams means that the beams are fitted together by inserting one of the beams in an aperture formed in the other beam. The metal reinforcement extends substantially throughout the full breadth and height of the apron. The apron according to the invention may be made much thinner because of this metal reinforcement than aprons so far, i.e. it may have a thickness of about 15 mm rather than 22–25 mm before. The metal reinforcement not only imparts strength but also high dimensional stability to the apron according to the invention.

The apron according to the invention, on the one hand, is fixed to the bare floor and, on the other hand, to the bottom side of the installation module. To this end, vertical grooves are formed in the foam at the lower edge of the apron. They receive support feet which are infinitely adjustable in height and to be fixed to the metal reinforcement embedded in the foam. Hereby the apron can take over the function of the usual support feet. Depressions formed in the foam at the upper edge of the apron serve for flush reception of the heads of fastening bolts to secure the apron at the installation module.

U-shaped sections of expanded metal or the like provide good edge protection of the apron according to the invention. As usual, a recess may be formed at the upper edge of the apron for passage of a waste water draining pipe of the installation module.

UP (unsaturated polyester), prestressed clay (fiber reinforced concrete), or polyester concrete have proved to be suitable foam materials.

BRIEF DESCRIPTION OF THE DRAWING

The invention will be described further, by way of example, with reference to the accompanying drawings, in which.

DESCRIPTION OF THE PREFERRED EMBODIMENT

Figure 1:
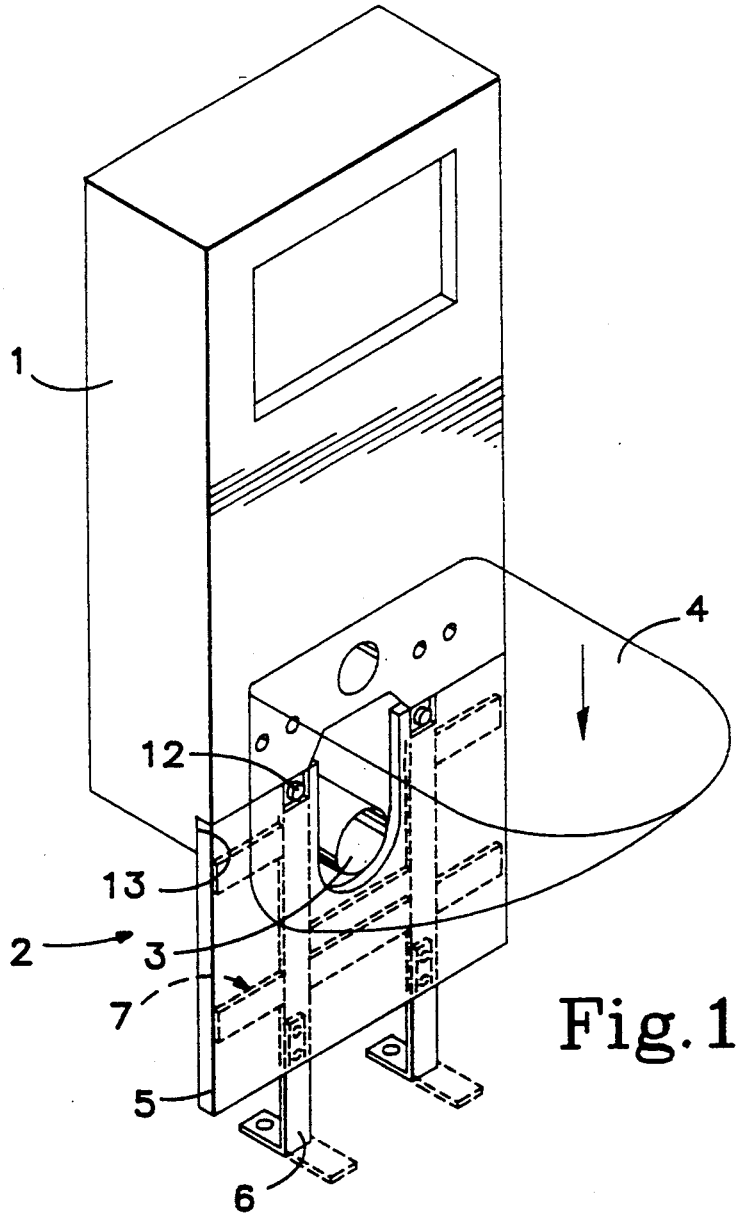
FIG. 1 is a perspective diagrammatic view of an installation module with an assembly space cover connected to it.

As shown in FIG. 1, there is an assembly space 2 under the installation module 1, and the waste water draining pipe elbow 3 which is only indicated leads into this space in order to be connected to a horizontally guided waste water draining pipe (not shown). This is an installation module for a water closet suspended from a wall. The installation module has a rabbet 13 at its lower forward edge.

The assembly space 2 is covered substantially flush with the front surface of the installation module by an apron 5 which, is received at its upper edge in the rabbet 13 and is fixed on the one hand, to the bottom side of the installation module and, on the other hand, to the bare floor by way of support feet 6. The apron 5 may end at a distance from the bare floor corresponding to the thickness of the floor covering to be applied on the floor.

Figure 2:
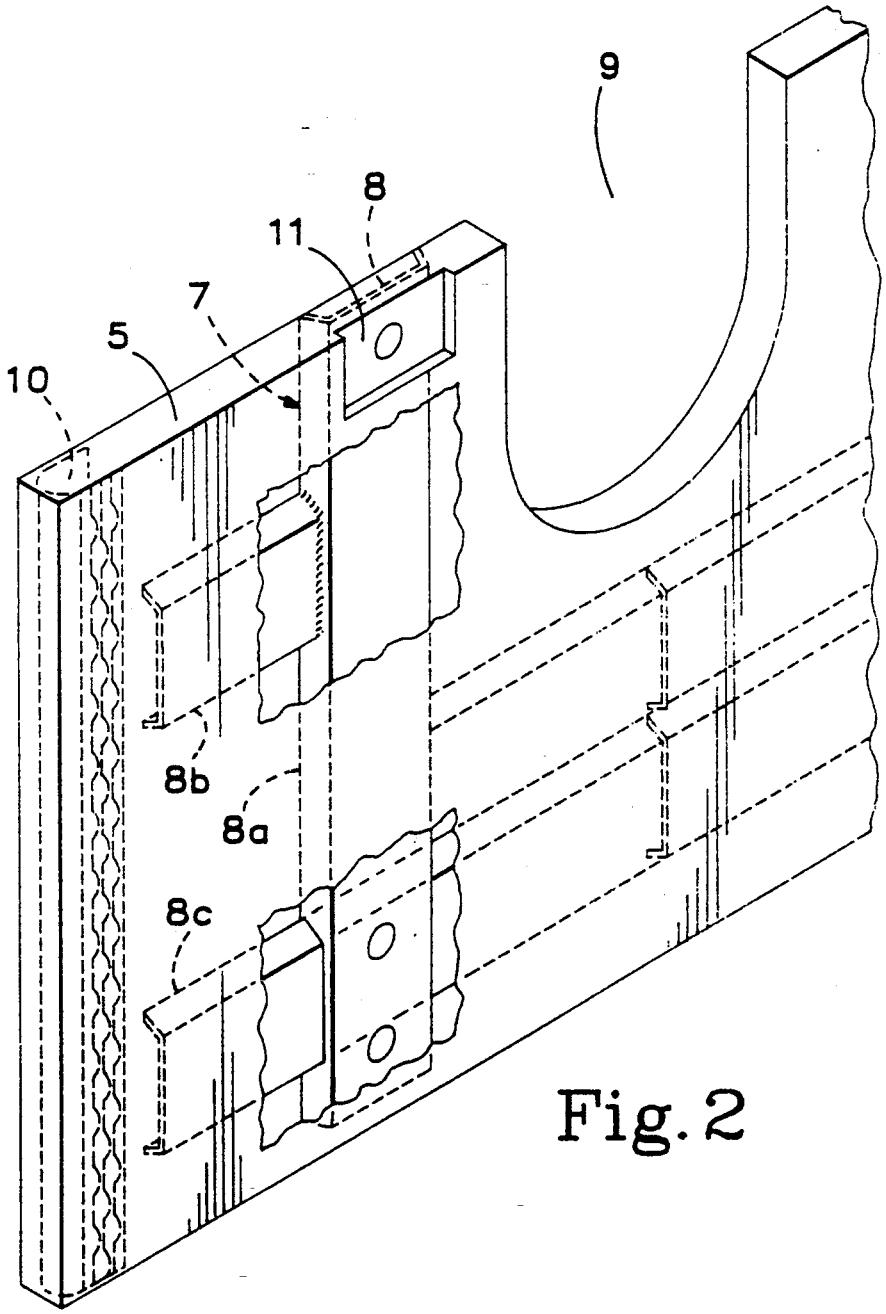
FIG. 2 enlarges a cutout of the assembly space cover shown in FIG. 1.

The apron 5 is a foamed panel in which a metal reinforcement 7 resistant to bending is incorporated in accordance with the invention. Referring to FIG. 2, this metal reinforcement 7 is composed of sectional beams 8 which are trough-shaped in cross section. The beams **8*a* and 8*b* are illustrated as being welded together whereas the beams 8*a* and 8*c* are illustrated as being in plugged connection. At either side of a central recess 9 for the waste water draining pipe elbow 3 at the upper edge of the apron 5, two vertical sectional beams 8 are embedded in the foam, and the two vertical section beams 8 are connected by two transverse sectional beams below the recess 9. Upper and lower sectional beam ends extend from the outer sides of the vertical sectional beams into the vicinity of the side edges of the apron so that the apron 5** is metal reinforced substantially throughout its entire area. In this manner it has not only high strength but also excellent dimensional stability.

U-shaped sections 10 of expanded metal are embedded in the foam along the side edges to protect the edges.

Vertical grooves (not to be seen) are formed in the foam at the lower edge of the apron 5 in the area of the vertical sectional beams 8. They serve to receive the support feet 6 and allow the feet to be fixed to the metal reinforcement embedded in the foam in a manner allowing infinite variation in height of the apron relative to the support feet. Recesses 11 formed in the foam at the upper edge of the apron serve for flush reception of the heads of fastening bolts 12 to secure the apron to the installation module by means of the metal reinforcement 7 embedded in the foam. The fastening bolts 12 engage in fastening metal sheets (not to be seen) which are integrated in the rabbet 13 receiving the apron 5 at the lower edge of the module.

What is claimed is:

1. An assembly space cover for use with an installation module for sanitary equipment, the installation module being adapted to be secured to a vertical wall above a floor surface so that an assembly space is defined between the floor surface and a bottom surface of the assembly module, said assembly space over comprising a foamed apron adapted to be secured to the installation module in the vicinity of the bottom surface thereof and with its exterior surface substantially flush with a front surface of the installation module, said foamed apron having a metal reinforcement (7) structure which is substantially resistant to bending embedded therein.

2. An assembly space cover according to claim 1, wherein the metal reinforcement structure is a welded structure.

3. An assembly space cover according to claim 2, wherein the metal reinforcement structure is composed of sectional beams.

4. An assembly space cover according to claim 1, wherein the metal reinforcement structure is a plugged structure.

5. An assembly space cover according to claim 4, wherein the metal reinforcement structure is composed of sectional beams.

6. An assembly space cover according to claim 1, wherein the apron is substantially in the form of a plate having a height dimension and a width dimension, and the metal reinforcement structure extends over substantially the entire height of the apron.

7. An assembly space cover according to claim 1, wherein the apron is substantially in the form of a plate having a height dimension and a width dimension, and the metal reinforcement structure extends over substantially the entire width of the apron.

8. An assembly space cover according to claim 1, wherein the apron has grooves extending from the lower edge of the apron towards an upper edge thereof, and the assembly space cover further comprises support members having leg portions fitted in the grooves and secured to the metal reinforcement structure.

9. An assembly space cover according to claim 8, wherein the metal reinforcement structure comprises at least two channel-section members and said grooves are defined by said channel-section members respectively.

10. An assembly space cover according to claim 1, formed with holes for receiving bolts for fastening the apron to the installation module, the holes being countersunk for receiving the heads of the bolts.

11. An assembly space cover according to claim 1, wherein the apron is formed with a recess at an upper edge thereof for passing a waste water drain pipe elbow.

12. An assembly space cover according to claim 1, further comprising channel-section protection members of expanded metal embedded in the foam for reinforcing the edges of the apron.

13. Sanitary apparatus comprising an installation module for sanitary equipment, said installation module having a front surface and a bottom surface and being adapted to be secured to a wall above a floor, so that an assembly space is defined between the bottom surface of the installation module and the floor, and the apparatus also comprising an installation space cover attached to the installation module for covering the assembly space, the assembly space cover comprising a foamed apron attached to the installation module and having a front surface that is substantially flush with the front surface of the installation module, and a metal reinforcement structure which is resistant to bending and is embedded in the foamed apron.

14. Apparatus according to claim 13, wherein the apron has grooves extending from a lower edge of the apron towards an upper edge thereof, and the assembly space cover further comprises support members having leg portions fitted in the grooves and secured to the metal reinforcement structure.

15. Apparatus according to claim 14, wherein the metal reinforcement structure comprises at least two channel-section members and said grooves are defined by said channel-section members respectively.

16. Apparatus according to claim 13, wherein the assembly space cover is formed with holes receiving bolts that fasten the apron to the installation module, the holes being countersunk and receiving the heads of the bolts.

17. Apparatus according to claim 13, wherein the apron is formed with a recess at an upper edge thereof for passing a waste water drain pipe elbow.

18. Apparatus according to claim 13, further comprising channel-section protection members of expanded metal embedded in the foam for reinforcing the edges of the apron.

19. Apparatus according to claim 13, wherein the installation module is made of foamed material, whereby the front surface of the installation module has similar surface characteristics to the front surface of the assembly space cover.

* * * * *